US006857373B2

(12) United States Patent
Checketts et al.

(10) Patent No.: US 6,857,373 B2
(45) Date of Patent: Feb. 22, 2005

(54) VARIABLY CURVED TRACK-MOUNTED AMUSEMENT RIDE

(76) Inventors: Stanley J. Checketts, 900 E. Canyon Rd., Providence, UT (US) 84332; Ned R. Hansen, 780 E. 300 N., Hyde Park, UT (US) 84318; Quin R. Checketts, 672 E. Center St., Providence, UT (US) 84332; Lawrence E. Allen, 3915 S. Highway 23, Wellsville, UT (US) 84339; Dody Bachtar, 1847 E. 2050 N., Layton, UT (US) 84040; Benjamin Clegg, 335 S. 50 E., Hyde Park, UT (US) 84318; Michael K. Winger, 352 Robin St., Smith Field, UT (US) 84335

( * ) Notice: Subject to any disclaimer, the term of this patent is extended or adjusted under 35 U.S.C. 154(b) by 0 days.

(21) Appl. No.: 10/262,327

(22) Filed: Oct. 1, 2002

(65) Prior Publication Data

US 2004/0060470 A1 Apr. 1, 2004

(51) Int. Cl.[7] ..... A63G 1/00
(52) U.S. Cl. ..... 104/53; 104/71; 446/288
(58) Field of Search ..... 104/63, 75, 56, 104/53; 446/288, 445, 231, 279; 106/75

(56) References Cited

U.S. PATENT DOCUMENTS 1,362,886 A * 12/1920 Hyla ..... 104/53
4,821,647 A * 4/1989 Powell et al. ..... 104/23.2
5,118,320 A * 6/1992 Miller ..... 446/288
5,433,153 A * 7/1995 Yamada ..... 104/63

* cited by examiner

*Primary Examiner*—Frantz F. Jules
(74) *Attorney, Agent, or Firm*—Fehr Law Firm; Thompson E. Fehr

(57) ABSTRACT

A variably curved track-mounted amusement ride having at least one outside curve and at least one inside curve, each lying substantially within a vertical plane and each having an axis of symmetry which is substantially horizontal. Preferably, the top curve is an outside curve; and preferably inside and outside curves alternate with each other. Also preferably, before the first curve, between each outside curve and each inside curve, and after the last curve is a substantially straight segment which slopes downward. The vertical distance occupied by an outside curve is less than that occupied by an inside curve. The track can retain a cart which runs on the track no matter what the orientation of the body of the cart is with respect to the track. Any means that is well known in the art can be used to raise the cart to the beginning of the track.

49 Claims, 7 Drawing Sheets

VARIABLY CURVED TRACK-MOUNTED AMUSEMENT RIDE

BACKGROUND OF THE INVENTION

1. Field of the Invention

This invention relates to an amusement ride that has both inside and outside substantially vertical curves shaped to optimize the number of curves which can be included within a given vertical space.

2. Description of the Related Art

U.S. Pat. No. 5,791,254, deals primarily with a cart which, according to lines 66 through 67 in column 5 of the patent, provides participants with the ability to rotate their seating about one or more axes of the cart. Such patent further provides, lines 7 through 9 in column 9, "FIG. 13 illustrates a complex roller coaster having multiple configurations, including . . . a horizontal 'plumber's drain' 82 . . . ."

The description of the "complex roller coaster" is extremely general. No details of the construction are given other than the basic shape. There is no indication that any brakes exist to control the speed of the cart through the turns. The segments between the curves of the "plumber's drain 82" appear to be equidistant from one another and completely horizontal. And no discussion occurs about any wheels or how they can be serviced while the cart remains in the type of track necessary to permit the body of the cart to be either above or below the track.

SUMMARY OF THE INVENTION

Critical to an understanding of the present invention are the terms "inside curve" and "outside curve."

FIG. 1 illustrates a general curve 1 in which lines 2 have been drawn that are perpendicular to the curve 1.

On a first side 3 of the curve 1, the lines 2 tend to diverge from one another as such lines 2 extend farther from the curve 1. On a second side 4 of the curve 1, the lines 2 tend initially, i.e., before any of the lines 2 cross one another, to converge toward one another as such lines 2 extend farther from the curve 1.

When the wheels 5 of a cart 6 follow the curve 1, the curve 1 is termed an outside curve if the body 7 of the cart 6 is on the first side 3 of the curve 1 and an inside curve if the body 7 of the cart 6 is on the second side 4 of the curve 1.

The track has both inside and outside curves where the curves lie substantially within a vertical plane and where the axis of symmetry for the curves is substantially horizontal. Furthermore, the track can retain the cart no matter what the orientation of the body of the car is with respect to the track. Brakes, which can be friction brakes or magnetic brakes, are preferably, but not necessarily, installed in the curves in order to control the speed of the cart through the curves. Substantially horizontal track segments preferably, but not necessarily, connect the curves; such substantially horizontal track segments are spaced farther apart where the body of the cart is to be between such segments than are segments which will not have the body of the cart between them, thereby enabling more curves to be placed within a given vertical space. Additionally, the substantially horizontal track segments are preferably, but not necessarily, slanted downward in the intended direction of travel to facilitate continued movement of the cart. And, also preferably but not necessarily, the track can be opened to service or replace wheels on the cart while the wheels remain in the track.

DESCRIPTION OF THE PREFERRED EMBODIMENT

Figure 1:
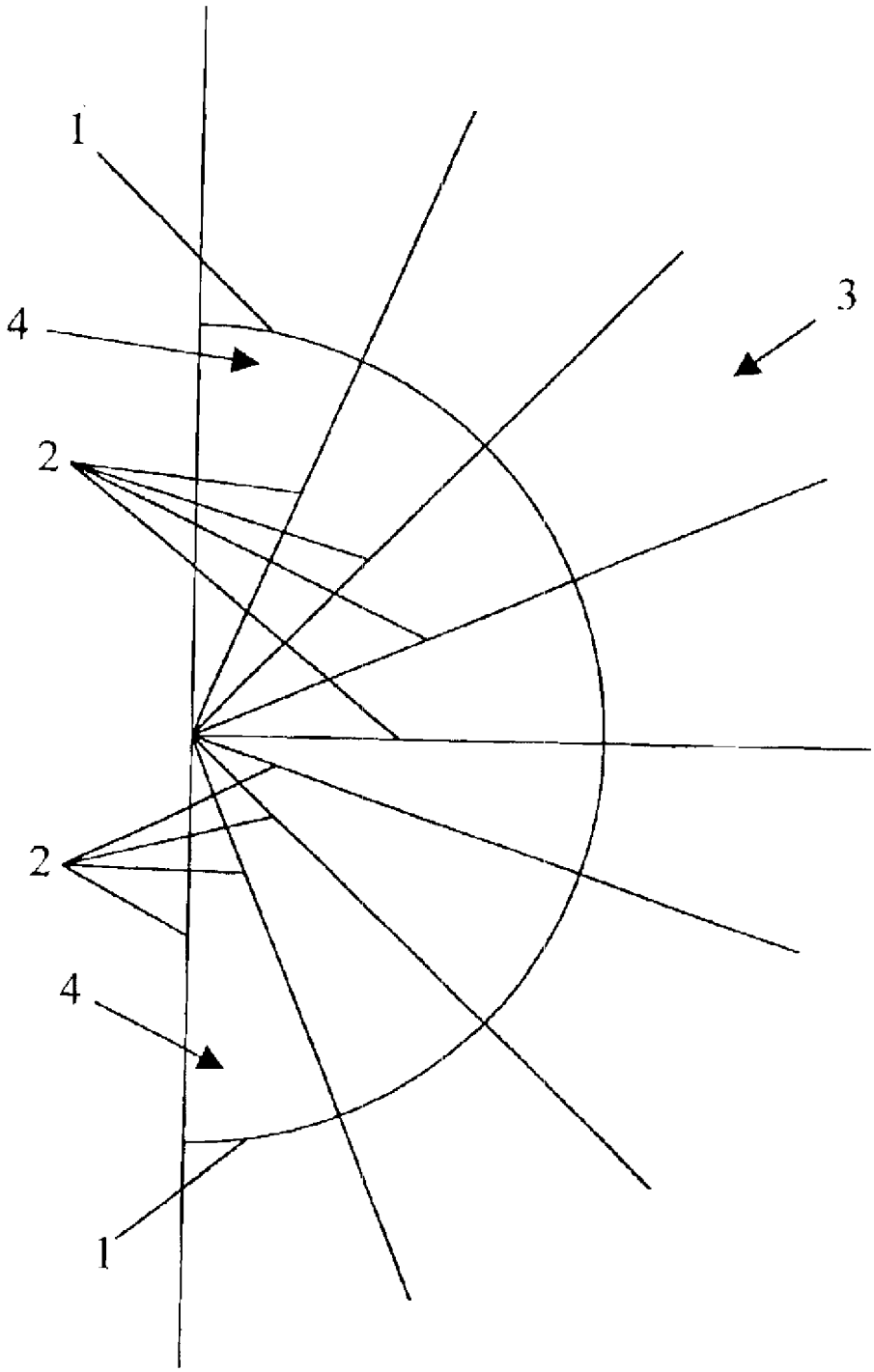
FIG. 1 illustrates a general curve.
Figure 2:
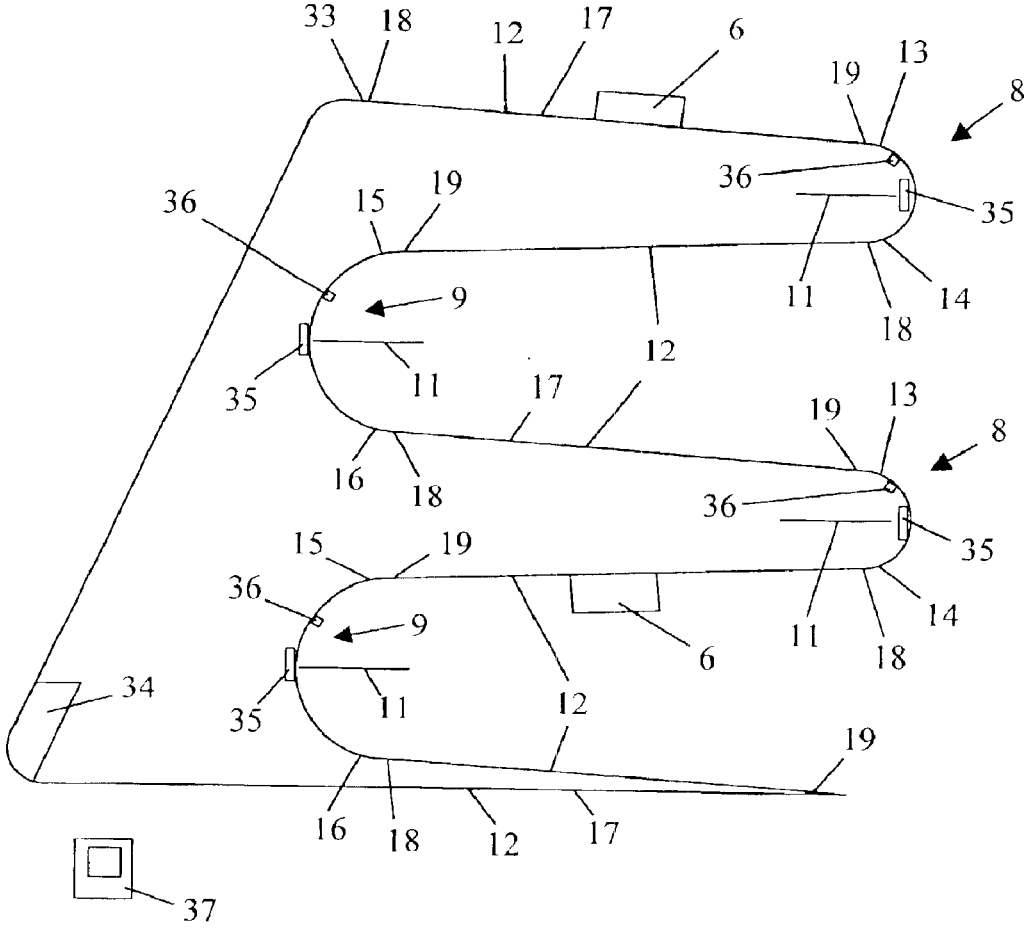
FIG. 2 is a lateral view of the preferred embodiment for the Variably Curved Track-mounted Amusement Ride.

The Variably Curved Track-mounted Amusement Ride has, as illustrated in FIG. 2, a track with at least one outside curve 8 and one inside curve 9 on which rides a cart 6 having wheels 5, a body 7, and any restraint 10 for one or more passengers that is well known in the art and that will prevent a passenger from leaving the cart 6 even when the cart is inverted. Preferably, the restraint 10 is that which is the subject of U.S. patent application Ser. No. 10/244,491, which was filed on Sep. 16, 2002.

The curves 8, 9 lie substantially within a vertical plane; and each curve 8, 9 has an axis of symmetry 11 which is substantially horizontal.

Preferably, outside curves 8 alternate with inside curves 9. Also preferably, as portrayed in FIG. 2, before the first curve 8, 9, between each outside curve 8 and each inside curve 9, and after the last curve 8, 9 is a substantially straight segment 12.

Outside curves 8 have a beginning 13 and an end 14; similarly inside curves 9 have a beginning 15 and an end 16. The beginning 13 and end 14 of an outside curve 8 are vertically closer to each other than are the beginning 15 and end 16 of an inside curve 9 since, unlike an outside curve 8, an inside curve 9 must accommodate the body 7 of a cart 6 which travels upon the track 17. Decreasing the distance between the beginning 15 and end 16 of an inside curve 9 enables more curves 8, 9 to be placed within a given vertical distance.

The curve 8, 9 that is above all other curves 8, 9 is termed the "first curve" and can be either an outside curve 8 or an inside curve 9, although it is preferable, but not necessary, to have an outside curve 8 above all other curves 8, 9.

Preferably, each substantially straight segment 12 slopes downward from a first end 18 to a second end 19, i.e., in the intended direction of travel. This facilitates movement of the cart 6.

Figure 3:
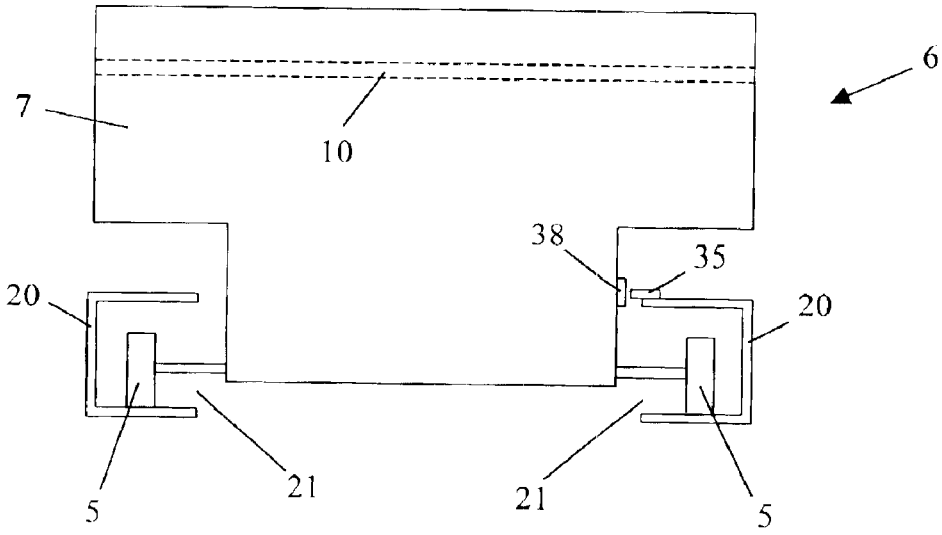
FIG. 3 is a cross-sectional view of a first embodiment for the track.
Figure 4:
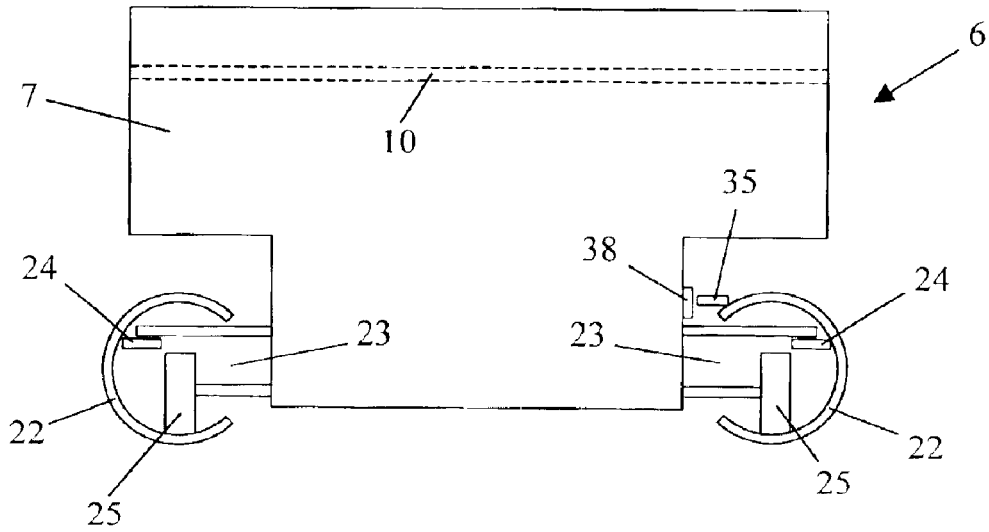
FIG. 4 is a cross-sectional view of an alternate embodiment for the track.
Figure 5:
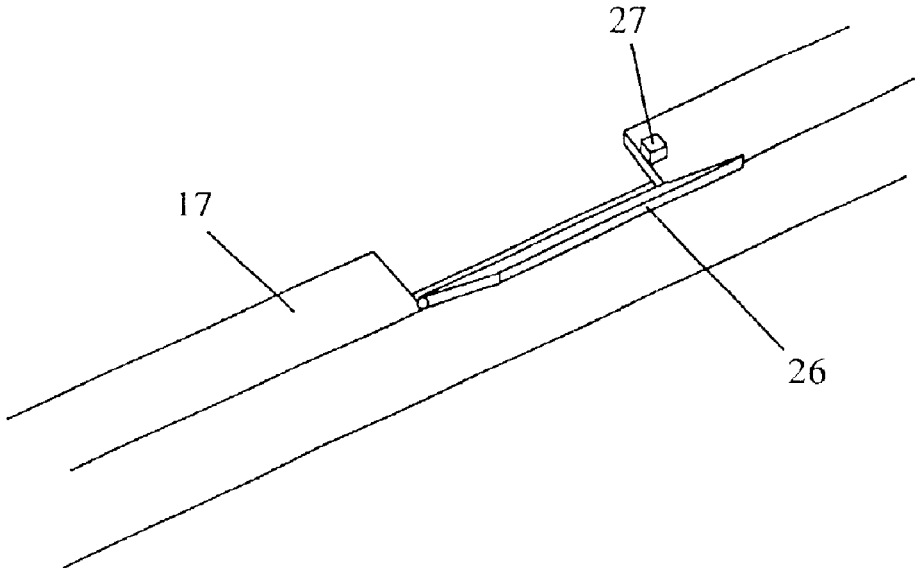
FIG. 5 illustrates a portion of the track which has been opened.
Figure 6:
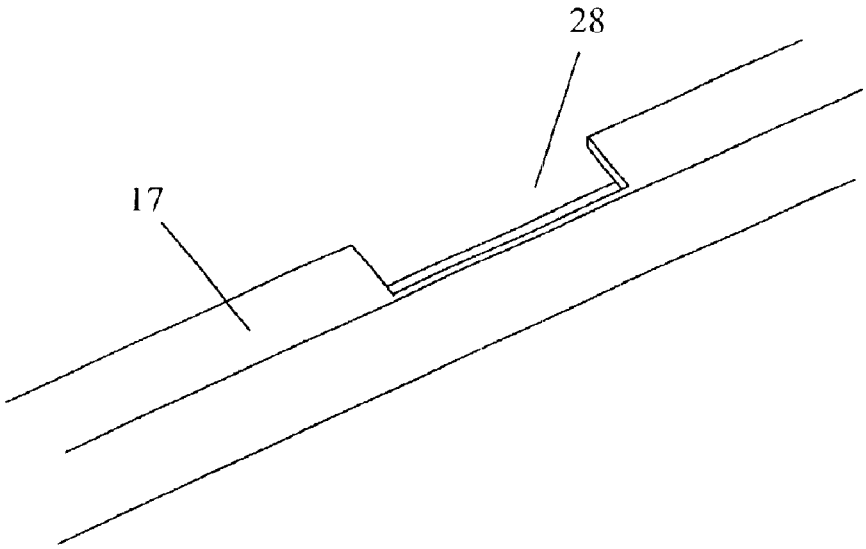
FIG. 6 shows a portion of the track which contains an aperture for servicing or replacing wheels of the cart.

The track 17 is any type of track 17 that is well known in the art for being capable of retaining the cart 6 no matter what the orientation of the body 7 of the cart 6 is with respect to the track 17. Examples of such a track 17 are opposing C-channels 20 with the longitudinally open portion 21 of each such C-channels 20 being oriented toward the longitudinally open portion 21 of the other such C-channel 20, as illustrated in FIG. 3, and opposing tubes 22, each tube 22 having a continuous longitudinal slot 23 oriented toward the other tube 22. Within the tubes 22 side wheels 24, preferably, and load wheels 25 are employed, as illustrated in FIG. 4. Additionally, the track 17 can preferably, but not necessarily, be opened to service or replace wheels 5 on the cart 6. This can be accomplished either by having a hinged section 26 that can be rotated and, preferably, locked with a lock 27, as shown in FIG. 5 using one of the opposing C-channels 20 as an example, or by simply having an aperture 28 in a portion of the track 17 that will never have to support the weight of the cart 6, as illustrated in FIG. 6 again using one of the opposing C-channels 20 as an example.

Figure 7:
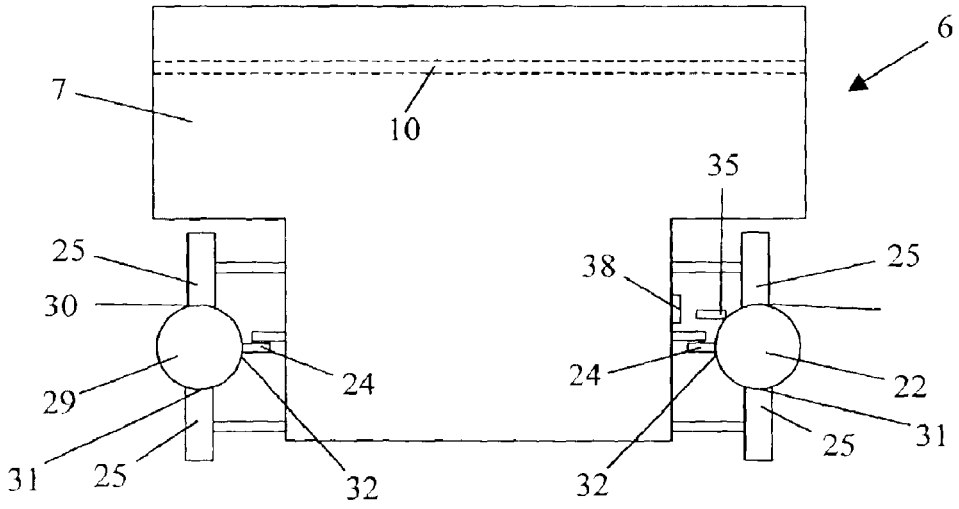
FIG. 7 is a cross-sectional view of a still further embodiment for the track.

A further example of an acceptable track 17 is, as illustrated in FIG. 7, any structure 29 having a top 30, bottom 31, and interior side 32. In such an example, two structures 29 are use substantially parallel to each other. With each such structure 29, the cart 6 employs, attached to the cart 6, load wheels 25 that run on the top 30 and the bottom 31 of the track as well as side wheels 24 which run on the interior side 32.

The cart 6 can be raised to the beginning 33 of the track 17 through any means 34 that is well known in the art. A non-exclusive list of examples for the cart-raising means 34 includes a chain drive; electrical induction motors; and a gas-powered cylinder such as those described in U.S. Pat. No. 6,176,788; and an elevator, preferably an elevator having more than one cart container with each such container following a rotary path. Of course, track 17 is used either in, and as part of, an elevator or, as part of the other types of cart-raising means 34, running from the second end 19 of the straight segment 12 after the last curve 8, 9 to the beginning 33.

After having been raised to the beginning 33 of the track 17, the cart 6 proceeds downward through the curves 8, 9. After having gone through all the curves 8, 9, the cart is again ready to be raised to the beginning 33 of the track 17.

At least one curve 8, 9 and, preferably, each curve 8, 9 contains a brake 35, preferably an adjustable brake, for controlling the speed of the cart 6. Preferably, any sensor 36, preferably a speed sensor, that is well known in the art for measuring a factor which is determinative of the speed of a body being subjected to a decelerative while descending under the influence of gravity measures such factor, preferably speed, in relation to the cart 6 and communicates such factor, preferably speed, to a computer control system 37 which is capable of being programmed with the desired speed for the cart 6; which is capable of being programmed with data indicating the initial force being applied by the adjustable brake 35 and what electrical signal from the computer control system 37 will produce what adjustment to the force generated by the adjustable brake 35; which is programmed to store in its memory and recall any signals that have been sent to the adjustable brake 35 to adjust the force the adjustable brake 35 is applying; and which is also capable of and programmed to determine, after having been programmed with a desired speed for the cart 6 and after having received the measurement from the sensor 36, the force for the adjustable brake 35 to apply so that the cart 6 will attain the desired speed. Having been programmed with data indicating the initial force being applied by the adjustable brake 35 and what electrical signal from the computer control system 37 will produce what adjustment to the force produced by the adjustable brake 35, the computer control system 37 determines the electrical signal that will cause the adjustable brake 35 to adjust the force it is applying in order to produce the force that will achieve the desired speed and communicates the appropriate electrical signal to the adjustable brake 35. Of course, after any such signal has been sent by the computer control system 37, such signal is recalled and utilized in determining any subsequent adjustment. (Another example of a factor which is determinative of speed under these circumstance is the weight or mass of the body being decelerated since the decelerative force must be proportional to such weight or mass.)

The brake 35 can be any brake that is well known in the art, such as a friction brake or a magnetic brake. The friction brake applies more force by pushing harder—through any means that is well known in the art, such as a pneumatic cylinder—against a plate 38 on the cart 6; the magnetic brake applies more force by having more current run through the brake 35.

We claim:

1. A variably curved track-mounted amusement ride, which comprises:

a cart having wheels, a body, and a restraint for one or more passengers;

a track having a beginning, at least one inside curve with such inside curve having a beginning and an end, and at least one outside curve with such outside curve having a beginning and an end and wherein each inside and outside curve lies substantially within a vertical plane and has an axis of symmetry which is substantially horizontal, said track being capable of retaining said cart no matter what the orientation of the body of said cart is with respect to said track and said track having the beginning and end of each outside curve vertically closer to each other than are the beginning and end of each inside curve; and a means for raising said cart to the beginning of said track.

2. The variably curved track-mounted amusement ride as recited in claim 1, wherein:

outside curves alternate with inside curves.

3. The variably curved track-mounted amusement ride as recited in claim 2, wherein:

the first curve is an outside curve.

4. The variably curved track-mounted amusement ride as recited in claim 3, further comprising:

a sufficient number of substantially straight segments having a first end and a second end that a substantially straight segment is located before the first curve, a substantially straight seament is located between each outside curve and each inside curve, and a substantially straight segment is located after the last curve.

5. The variably curved track-mounted amusement ride as recited in claim 4, wherein:

each substantially straight segment slopes downward from the first end to the second end of such substantially straight segment.

6. The variably curved track-mounted amusement ride as recited in claim 4, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with a desired speed for said cart, said computer control system communicating with said sensor to receive the measurement of said sensor, said computer control system being capable of and programmed to determine, after having been programmed with the desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, after having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

7. The variably curved track-mounted amusement ride as recited in claim 6, wherein:

each substantially straight segment slopes downward from the first end to the second end of such substantially straight segment.

8. The variably curved track-mounted amusement ride as recited in claim 6, wherein:

said track contains an aperture, for servicing and removing wheels from said cart, in a portion of said track that will never have to support the weight of said cart.

9. The variably curved track-mounted amusement ride as recited in claim 8, wherein:

each substantially straight segment slopes downward from the first end to the second end of such substantially straight segment.

10. The variably curved track-mounted amusement ride as recited in claim 4, wherein:

said track contains an aperture, for servicing and removing wheels from said cart, in a portion of said track that will never have to support the weight of said cart.

11. The variably curved track-mounted amusement ride as recited in claim 10, wherein:

each substantially straight segment slopes downward from the first end to the second end of such substantially straight segment.

12. The variably curved track-mounted amusement ride as recited in claim 3, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with a desired speed for said cart, said computer control system communicating with said sensor to receive the measurement of said sensor, said computer control system being capable of and programmed to determine, after having been programmed with the desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, after having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

13. The variably curved track-mounted amusement ride as recited in claim 12, wherein:

said track contains an aperture, for servicing and removing wheels from said cart, in a portion of said track that will never have to support the weight of said cart.

14. The variably curved track-mounted amusement ride as recited in claim 3, wherein:

said track contains an aperture, for servicing and removing wheels from said cart, in a portion of said track that will never have to support the weight of said cart.

15. The variably curved track-mounted amusement ride as recited in claim 2, further comprising:

a sufficient number of substantially straight segments having a first end and a second end that a substantially straight segment is located before the first curve, a substantially straight segment is located between each outside curve and each inside curve, and a substantially straight segment is located after the last curve.

16. The variably curved track-mounted amusement ride as recited in claim 15, wherein:

each substantially straight segment slopes downward from the first end to the second end of such substantially straight segment.

17. The variably curved track-mounted amusement ride as recited in claim 15, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with the desired speed for said cart, said computer control system communicating with said sensor to receive the measurement of said sensor, said computer control system being capable of and programmed to determine, after having been programmed with a desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, alter having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

18. The variably curved track-mounted amusement ride as recited in claim 17, wherein:

each substantially straight segment slopes downward from the first end to the second end of such substantially straight segment.

19. The variably curved track-mounted amusement ride as recited in claim 17, wherein:

said track contains an aperture, for servicing and removing wheels from said cart, in a portion of said track that will never have to support the weight of said cart.

20. The variably curved track-mounted amusement ride as recited in claim 19, wherein:

each substantially straight segment slopes downward from the first end to the second end of such substantially straight segment.

21. The variably curved track-mounted amusement ride as recited in claim 15, wherein:

said track contains an aperture, for servicing and removing wheels from said cart, in a portion of said track that will never have to support the weight of said cart.

22. The variably curved track-mounted amusement ride as recited in claim 21, wherein:

each substantially straight segment slopes downward from the first end to the second end of such substantially straight segment.

23. The variably curved track-mounted amusement ride as recited in claim 2, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with the desired speed for said cart, said computer control system communicating with said sensor to receive the measurement of said sensor, said computer control system being capable of and programmed to determine, after having been programmed with a desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, after having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

24. The variably curved track-mounted amusement ride as recited in claim 23, wherein:

said track contains an aperture, for servicing and removing wheels from said cart, in a portion of said track that will never have to support the weight of said cart.

25. The variably curved track-mounted amusement ride as recited in claim 2, wherein:

said track contains an aperture, for servicing and removing wheels from said cart, in a portion of said track that will never have to support the weight of said cart.

26. The variably curved track-mounted amusement ride as recited in claim 1, wherein:

the first curve is an outside curve.

27. The variably curved track-mounted amusement ride as recited in claim 26, further comprising:

a substantially straight segment having a first end and a second end, such substantially straight segment being located before the first curve, between each outside curve and each inside curve, and after the last curve.

28. The variably curved track-mounted amusement ride as recited in claim 27, wherein:

each substantially straight segment slopes downward from the first end to the second end of such substantially straight segment.

29. The variably curved track-mounted amusement ride as recited in claim 27, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with a desired speed for said cart, said computer control system communicating with said sensor to receive the measurement of said sensor, said computer control system being capable of and programmed to determine, after having been programmed with the desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, after having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

30. The variably curved track-mounted amusement ride as recited in claim 29, wherein:

each substantially straight segment slopes downward from the first end to the second end of such substantially straight segment.

31. The variably curved track-mounted amusement ride as recited in claim 29, wherein:

said track contains an aperture, for servicing and removing wheels from said cart, in a portion of said track that will never have to support the weight of said cart.

32. The variably curved track-mounted amusement ride as recited in claim 31, wherein:

each substantially straight segment slopes downward from the first end to the second end of such substantially straight segment.

33. The variably curved track-mounted amusement ride as recited in claim 27, wherein:

said track contains an aperture, for servicing and removing wheels from said cart, in a portion of said track that will never have to support the weight of said cart.

34. The variably curved track-mounted amusement ride as recited in claim 33, wherein:

each substantially straight segment slopes downward from the first end to the second end of such substantially straight segment.

35. The variably curved track-mounted amusement ride as recited in claim 26, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with a desired speed for said cart, said computer control system communicating with said sensor to receive the measurement of said sensor, said computer control system being capable of and programmed to determine, after having been programmed with the desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, alter having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

36. The variably curved track-mounted amusement ride as recited in claim 35, wherein:

said track contains an aperture, for servicing and removing wheels from said cart, in a portion of said track that will never have to support the weight of said cart.

37. The variably curved track-mounted amusement ride as recited in claim 26, wherein:

said track contains an aperture, for servicing and removing wheels from said cart, in a portion of said track that will never have to support the weight of said cart.

38. The variably curved track-mounted amusement ride as recited in claim 1, further comprising:

a substantially straight segment having a first end and a second end, such substantially straight segment being located before the first curve, between each outside curve and each inside curve, and after the last curve.

39. The variably curved track-mounted amusement ride as recited in claim 38, wherein:

each substantially straight segment slopes downward from the first end to the second end of such substantially straight segment.

40. The variably curved track-mounted amusement ride as recited in claim 38, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with a desired speed for said cart, said computer control system communicating with said sensor to receive the measurement of said sensor, said computer control system being capable of and programmed to determine, after having been programmed with the desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, after having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

41. The variably curved track-mounted amusement ride as recited in claim 40, wherein:

each substantially straight segment slopes downward from the first end to the second end of such substantially straight segment.

42. The variably curved track-mounted amusement ride as recited in claim 40, wherein:

said track contains an aperture, for servicing and removing wheels from said cart, in a portion of said track that will never have to support the weight of said cart.

43. The variably curved track-mounted amusement ride as recited in claim 42, wherein:

each substantially straight segment slopes downward from the first end to the second end of such substantially straight segment.

44. The variably curved track-mounted amusement ride as recited in claim 38, wherein:

said track contains an aperture, for servicing and removing wheels from said cart, in a portion of said track that will never have to support the weight of said cart.

45. The variably curved track-mounted amusement ride as recited in claim 44, wherein:

each substantially straight segment slopes downward from the first end to the second end of such substantially straight segment.

46. The variably curved track-mounted amusement ride as recited in claim 1, further comprising:

an adjustable brake located in each curve;

a sensor for measuring and communicating a measurement of a factor which is determinative of the speed of said cart when said cart is being subjected to a decelerative force while descending under the influence of gravity; and a computer control system, said computer control system being capable of being programmed with the desired speed for said cart, said computer control system communicating with said sensor to receive the measurement of said sensor, said computer control system being capable of and programmed to determine, after having been programmed with a desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, after having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

47. The variably curved track-mounted amusement ride as recited in claim 46, wherein:

said track contains an aperture, for servicing and removing wheels from said cart, in a portion of said track that will never have to support the weight of said cart.

48. The variably curved track-mounted amusement ride as recited in claim 1, wherein:

said track contains an aperture, for servicing and removing wheels from said cart, in a portion of said track that will never have to support the weight of said cart.

49. A variably curved track-mounted amusement ride, which comprises:

a cart having wheels, a body, and a restraint for one or more passengers;

a track having a beginning, at least one inside curve with such inside curve having a beginning and an end, at least one outside curve with such outside curve having a beginning and an end with the first curve being an outside curve, and a sufficient number of substantially straight segments having a first end and a second end that a substantially straight segment is located before the first curve, a substantially straight segment is located between each outside curve and each inside curve, and a substantially straight segment is located after the last curve, with each substantially straight segment sloping downward from the first end to the second end of such substantially straight segment, with the curves alternating between being outside curves and inside curves along the track, and wherein each inside and outside curve lies substantially within a vertical plane and has an axis of symmetry which is substantially horizontal, said track being capable of retaining said cart no matter what the orientation of the body of said cart is with respect to said track by being comprised of opposing C-channels with the longitudinally open portion of each such C-channel being oriented toward the longitudinally open portion of the other such C-channel, said track having the beginning and end of each outside curve vertically closer to each other than are the beginning and end of each inside curve, and said track containing an aperture, for servicing and removing wheels from said cart, in a portion of said track that will never have to support the weight of said cart;

a means for raising said cart to the beginning of said track;

an adjustable brake located in each curve;

a speed sensor for measuring and communicating the speed of said cart when said cart is being subjected to a decelerative force while descending under the influence of gravity; and a computer control system, said computer control system being capable of being programmed with a desired speed for said cart, said computer control system communicating with said sensor to receive the measurement of said sensor, said computer control system being capable of and programmed to determine, after having been programmed with the desired speed for said cart and after having received the measurement from the sensor, the force for said adjustable brake to apply so that said cart will attain the desired speed, said computer control system being capable of being programmed with data indicating the initial force being applied by said adjustable brake and what electrical signal from said computer control system will produce what adjustment to the force generated by said adjustable brake, said computer control system being programmed to store in its memory and to recall any signals that have been sent to said adjustable brake to adjust the force said adjustable brake is applying, and said computer control system being programmed to determine and to communicate to said adjustable brake, after having been programmed with data indicating the initial force being applied by said adjustable brake and what electrical signal from said computer control system will produce what adjustment to the force generated by said adjustable brake, the electrical signal that will cause said adjustable brake to adjust the force it is applying in order to produce the force that will achieve the desired speed.

* * * * *